US008939093B2

(12) United States Patent
Mero

(10) Patent No.: US 8,939,093 B2
(45) Date of Patent: Jan. 27, 2015

(54) BOILER GRATE AND A BOILER

(75) Inventor: Timo Mero, Nokia (FI)

(73) Assignee: Valmet Power Oy, Tampere (FI)

( * ) Notice: Subject to any disclaimer, the term of this patent is extended or adjusted under 35 U.S.C. 154(b) by 100 days.

(21) Appl. No.: 13/352,625

(22) Filed: Jan. 18, 2012

(65) Prior Publication Data

US 2012/0180708 A1 Jul. 19, 2012

(30) Foreign Application Priority Data

Jan. 18, 2011 (FI) ..... 20115049

(51) Int. Cl.

| | |
|---|---|
| ***F23C 10/24*** | (2006.01) |
| ***F23H 1/02*** | (2006.01) |
| ***F23H 15/00*** | (2006.01) |
| ***F23J 1/06*** | (2006.01) |
| ***F23C 10/20*** | (2006.01) |

(52) U.S. Cl.

CPC ..... *F23C 10/24* (2013.01); *F23C 10/20* (2013.01); *F23H 15/00* (2013.01)

USPC ..... 110/245; 110/170; 110/259; 126/173

(58) Field of Classification Search

CPC ..... F23J 1/00; F23J 1/02; F23J 1/06; F23C 10/20; F23C 10/22; F23C 10/24; F23C 10/26; F23H 15/00; F23H 11/28; F23H 11/24; F23H 11/22; F23H 2900/03021; F23H 2900/17002

USPC ..... 110/165 R, 170, 245, 259, 266, 270, 110/297, 298, 300, 114, 278, 281, 285, 110/291; 122/379, 387; 126/173, 169, 126/152 B, 159

See application file for complete search history.

(56) References Cited

U.S. PATENT DOCUMENTS

| | | | | | |
|---|---|---|---|---|---|
| 192,911 | A | * | 7/1877 | Fox | 126/173 |
| 1,318,852 | A | * | 10/1919 | Dray | 126/173 |
| 1,676,830 | A | * | 7/1928 | Larsen | 126/173 |
| 2,282,713 | A | * | 5/1942 | Eske | 110/285 |
| 4,408,944 | A | * | 10/1983 | Christian | 414/216 |
| 4,479,441 | A | * | 10/1984 | Somodi | 110/291 |
| 5,425,331 | A | * | 6/1995 | Abdulally | 110/245 |
| 5,568,776 | A | * | 10/1996 | Suraniti et al. | 110/245 |
| 5,743,197 | A | * | 4/1998 | Kinni et al. | 110/245 |

(Continued)

FOREIGN PATENT DOCUMENTS

| | | | |
|---|---|---|---|
| DE | 102005061298 | A1 | 9/2007 |
| SE | 501226 | C2 | 12/1994 |
| WO | WO-03090919 | A1 | 11/2003 |

OTHER PUBLICATIONS

Finnish Search Report—Sep. 27, 2011.

*Primary Examiner* — Kenneth Rinehart
*Assistant Examiner* — Tavia Sullens
(74) *Attorney, Agent, or Firm* — Venable LLP; Eric J. Franklin

(57) ABSTRACT

A boiler grate including air channels for supplying primary air to a furnace of a boiler. At least one channel, which is open on top, is arranged to collect ash and material from the furnace. At least one removal element is arranged in the channel and to mechanically move ash and material along the channel. A boiler includes a grate, a furnace which is limited by the walls of the furnace and the grate, and an ash chute, which is arranged to remove ash and material from the furnace. The ash removal elements is arranged to move ash and material towards the air chute.

16 Claims, 4 Drawing Sheets

(56) References Cited

U.S. PATENT DOCUMENTS 6,263,837 B1 * 7/2001 Utunen et al. ..... 110/245
6,981,455 B2 * 1/2006 Lefcort ..... 110/268
7,244,399 B2 * 7/2007 Myohanen et al. ..... 422/143
7,461,604 B2 * 12/2008 Beaumont et al. ..... 110/165 R

* cited by examiner

BOILER GRATE AND A BOILER

FIELD OF THE INVENTION

The invention relates to a boiler grate. The invention also relates to a boiler.

BACKGROUND OF THE INVENTION

A problem with boilers utilizing bubbling fluidized bed (BFB) and circulating fluidized bed (CFB) is the efficient removal of impurities brought along with fuel, such as stones, metal material and other incombustible impurities, from the grate during the combustion process. At present, in connection with fluidized bed combustion the removal of coarse material from the grate is generally based on the natural flow of the material towards outlets. In addition to the shaping of the bottom of the grate it is also typical to use primary air to direct sand and said impurities to different channels, from where the sand and impurities are directed to an outlet or outlets. This type of technology is disclosed, inter alia, in publication WO 03/090919.

There are some problems in solutions according to prior art. For example, the directing with primary air is not always efficient enough. Especially in moving heavy materials the transfer effect of primary air is often too small. Heavy material may remain between nozzles and removing it from the grate may require regular shutdown of the boiler. Another problem with this solution is the heavy wearing of the primary air nozzles, because the bed material travelling over the air nozzles wears the nozzles. Yet another problem with this type of material removal is the unevenness of the removal. The flow profile of the bed material is difficult to make even, and removal especially from some edge areas of the grate may become problematic. In addition, efficient transfer of material requires a relatively large number of primary air nozzles, for example approximately 50 nozzles per $m^2$, and therefore the implementation of this type of a solution may be expensive.

BRIEF SUMMARY OF THE INVENTION

The purpose of the present invention is to provide a solution for making the removal of bed ash more efficient from the grate of a boiler, such as a fluidized bed boiler.

The grate according to the invention is characterized in what will be presented in claim 1. The boiler according to the invention is characterized in what will be presented in claim 7.

DESCRIPTION OF THE DRAWINGS

In the following, the invention will be described in more detail with reference to the appended drawings, in which

In FIGS. 1 to 7, the same numerals or symbols are used for corresponding parts.

DETAILED DESCRIPTION OF THE INVENTION

Figure 1:
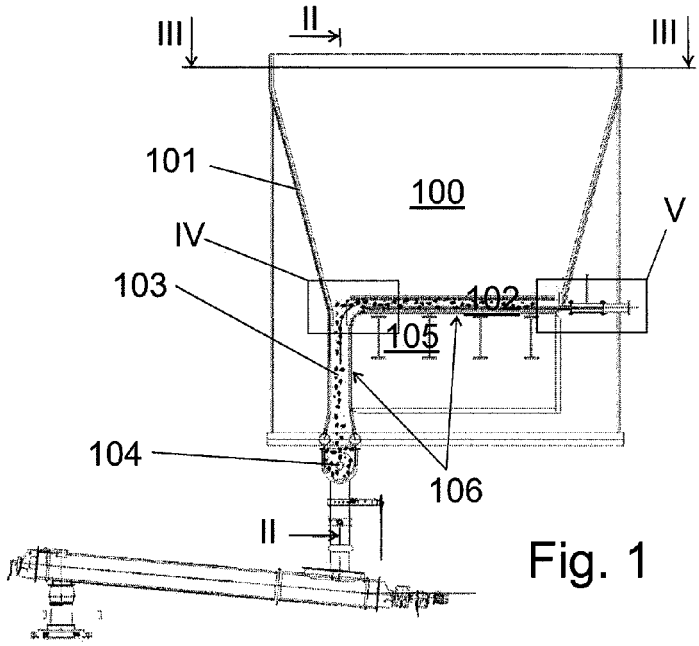
FIG. 1 shows a lower part of a fluidized bed boiler and an ash removal equipment in a side view.

FIG. 1 shows a cross section of a lower part of a boiler and an ash removal equipment. The boiler comprises a furnace 100, limited on the sides by boiler walls 101 and from below by a grate 102. The grate is shaped planar and it may be substantially horizontal. Advantageously the angle of the grate in relation to the horizontal plane is less than 10 degrees, and most advantageously less than 5 degrees. The lower part of the boiler comprises an ash chute 103, the edge of which is connected to the edge of the grate. The ash collected on the grate is directed to the ash chute and the ash is carried along the ash chute to, or dropped onto an ash collection conveyor 104. The ash chute may comprise several separate hoppers in a direction perpendicular to the plane of the figure, and below each hopper there may be a separate ash conveyor. In addition, the boiler may comprise more ash chutes, the edges of which are connected to the edge of the grate. The ash chute reaches several channels in the grate. Ash refers to residue created in the combustion of fuel, as well as unburnt impurities brought along with fuel, such as stones, metal material and other unburnt material.

The boiler of FIG. 1 is a fluidized bed boiler, for example a bubbling fluidized bed boiler or a circulating fluidized bed boiler, where primary air is supplied to the furnace via the grate 102 in such a manner that the solids in the furnace are fluidized by means of this air flow. The solids in the furnace of the fluidized bed boiler comprise material to be burnt, such as biomass, inert bed material, such as sand, and impurities carried along with the material to be burnt. The primary air is directed through the grate via air channels. An air box 105 is located below the grate of the fluidized bed boiler, via which air box the primary air is directed to the furnace 100 of the boiler. The furnace of the boiler may be pressurized to enhance burning. The grate 102, the ash chute 103 and the boiler wall 101 may be cooled, in which case these structures comprise cooling pipes 106. The cooling pipes may be used to cool the grate and to recover heat created in the boiler. In other boilers besides fluidized bed boiler it may also be possible to collect the ash collected on the grate via an ash chute to an ash collection conveyor.

The grate 102 shown in FIG. 1 is rectangular, and the ash chute 103 is arranged on the other edge of the grate, next to the grate and the wall, and the ash chute is substantially the same size as the grate in a direction perpendicular to the plane of FIG. 1. The ash chute 103 may be located on the central line of the grate as well, e.g. between parts of a grate divided into two parts, or the grate may be connected to several ash chutes. The ash chute or chutes are not used for supplying primary air, because even air supply enables the even combustion and even fluidization of the bed in a fluidized bed boiler.

Figure 2:
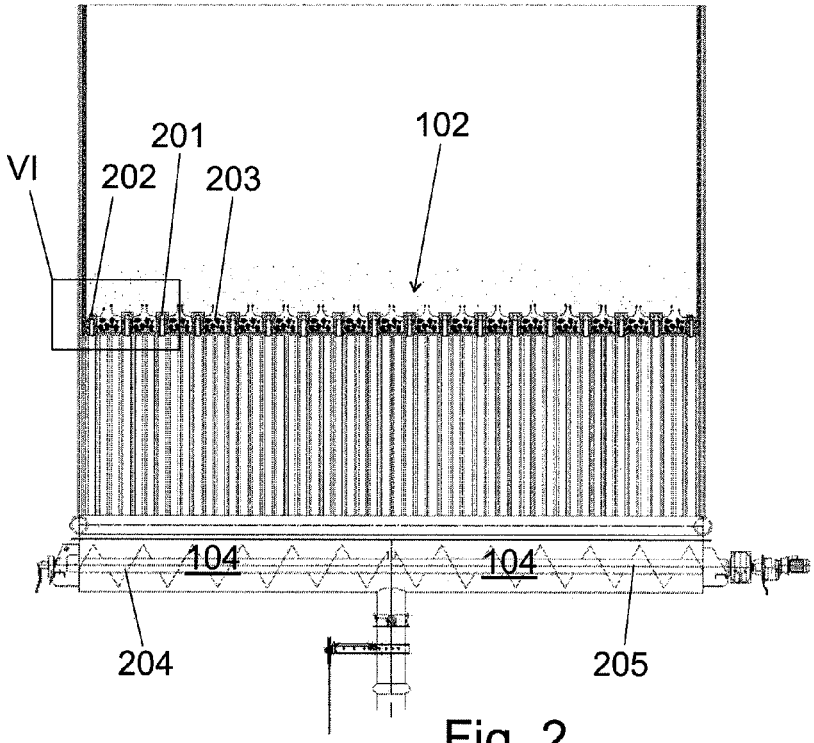
FIG. 2 shows a lower part of a fluidized bed boiler and an ash removal equipment in another side view, in a cross section corresponding to plane II-II of FIG. 1.

FIG. 2 shows the cross section of the lower part of a fluidized bed boiler along the line II-II of FIG. 1. The grate 102 comprises fluidizing air nozzles, in this example two-way air nozzles 201 and one-way air nozzles 202. A purpose of the air nozzles is to direct primary air through the grate to the furnace. The air nozzles comprise, e.g. a vertical air channel for primary air, leading through the grate. In a typical fluidized bed boiler the air nozzles are set in rows, and the air nozzles 202 of the outermost rows are one-way, while the other air nozzles 201 are two-way. The air nozzles shown in FIG. 2 are elevated from the bottom of the grate, in which case channels 203 are created between the air nozzles. The channels are below the air jets of the air nozzles. Typically the air nozzles are at least partly located inside the refractory acting as a shield, or over it, and the channels are located lower than the upper part of the air nozzles, which remains visible and where the air jets are located. In this example, the air jets are substantially horizontal.

Figure 3:
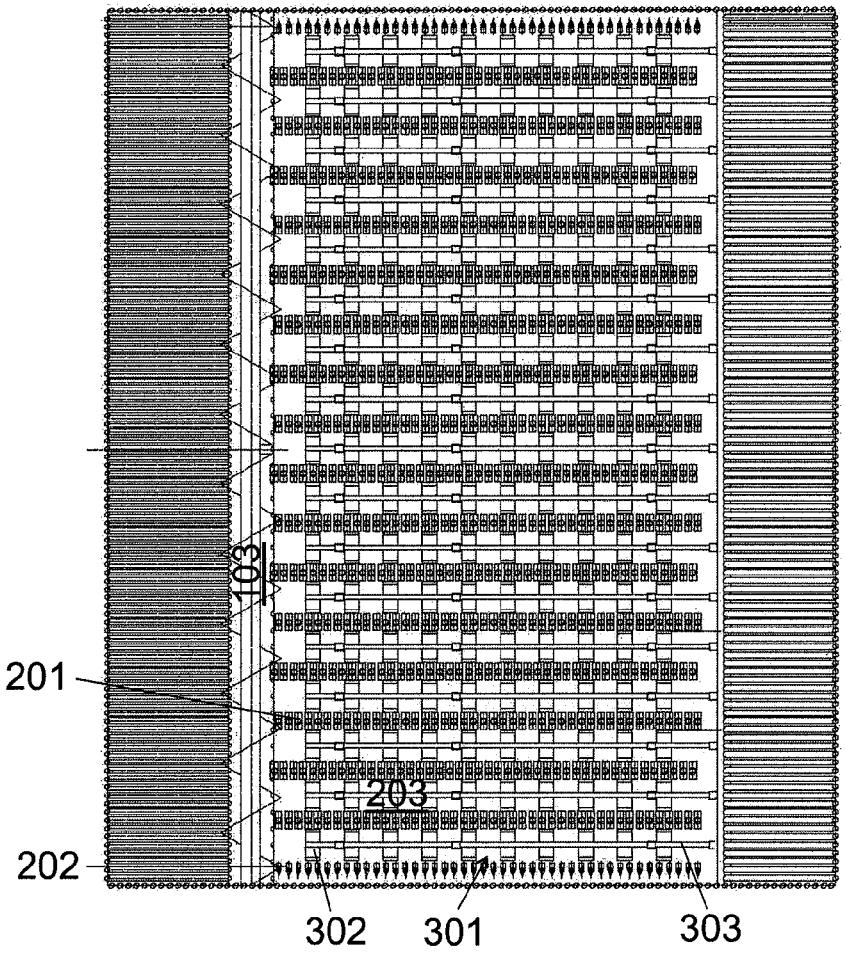
FIG. 3 shows a grate of a fluidized bed boiler in a vertical view, in a cross section corresponding to plane III-III of FIG. 1.

On the grate plane, i.e. in a direction perpendicular to the direction of FIG. 2, the channels 203 are substantially straight, as shown in FIG. 3, and their shape continues the same over the entire grate. From the top, the channels are open, grooves or groove-like structures, in which case they may collect the depositing ash and other material. At the same time, ash is transferred via a channel to a removal site. The bottom of the channel is substantially parallel to the plane of the grate. The height of the air nozzles and thus, the height of the channels may be, for example 200 to 250 mm. The width of the channels may be of the same order as the height of the channel. During the combustion process ash and its heavy materials are collected mainly in channels 203, from where they are transferred, or they transfer to the ash chute 103. One purpose of the channels 203 is therefore to collect ash and the unburnt material contained by it. Due to the air nozzles 201 and 202 the grate operates as an air screen, as the air flow discharged from the nozzles fluidizes small particles, such as bed particles, but is not strong enough to fluidize larger particles. Such large particles sink to the bottom of the grate, especially to channels 203.

The ash moves through the ash chute 103 to the ash collection conveyor 104 (FIG. 2). The ash collection conveyor may be, for example, one screw conveyor, or it may be composed of two screw conveyors 204 and 205 transferring to different directions. Moving ash to the ash chute during the combustion process may be difficult. The current technical solutions to this problem are described in the background of the invention.

FIG. 3 shows an embodiment of a grate in a top view. In this embodiment an ash removal means is arranged in each channel 203 between air nozzles 201, 202. The ash removal means may be arranged in the actual channel, since one purpose of the channel is to collect ash and the unburnt material contained in it. It is typical for some embodiments of the ash removal means that they are located below the air jets of the air nozzles, and at the same time also below the air nozzles and the upper level of the refractory.

The ash removal means shown in FIGS. 3 to 6 is a push bar discharger 301. The push bar discharger comprises at least one scraper 302 and a bar 303, to which at least one scraper is attached. The push bar discharger is arranged to move on the grate plane towards the ash chute 103 and its scraper is shaped in such a manner that when the push bar discharger moves, the scraper pushes ash in front of it towards the ash chute 103. Especially the push bar discharger is arranged in the channel 203 of the grate, in which case at least one scraper is arranged to push ash in the grate channel towards the ash chute. FIG. 3 does not show the bed material in order to illustrate the grate structure.

The ash removal means may be substantially rigid in the ash transfer direction, but it may be less rigid in a direction perpendicular to this direction. For example, the push bar discharger 301 is substantially rigid in the direction of the bar 303. However, in the direction perpendicular to the bar, the push bar discharger is not especially steady. The first end of the push bar discharger, which in the case of FIG. 3 refers to the end at the right edge of the grate, is directed outside the furnace through the wall of the furnace of the boiler. This type of a through hole mechanically supports the bar of the push bar discharger in directions perpendicular to it. Since the bar is not laterally especially rigid, in some cases the material moving in the furnace could bend the push bar discharger laterally. In the embodiment shown in the figures another purpose of the channel 203 is to mechanically support the push bar discharger in a grate plane direction perpendicular to the bar. The channel in the grate therefore functions (the channels function) as a support structure, which is arranged to support the push bar discharger (push bar dischargers) in the grate plane direction perpendicular to the bar. This type of a support structure could also be, for example, a support plate, through which the bar 303 of the push bar discharged could be directed. It could be possible to arrange such a support plate also on the wall of the furnace in such a manner that the other end of the push bar discharger would lean on such a support plate.

Figure 4:
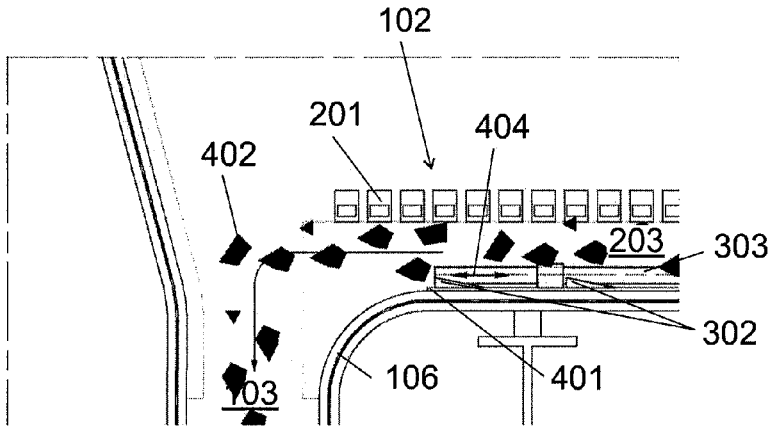
FIG. 4 shows an enlargement of part IV of FIG. 1.

FIG. 4 shows a detail of the grate according to FIG. 1 in a more detailed view. The detail in question is marked by reference IV in FIG. 1. FIG. 4 shows the edge of the grate 102 on the side of the ash chute 103. The grate 102 and the ash chute 103 are cooled by means of cooling pipes 106. The heat transfer medium moving in the cooling pipes may be, for example, water and the heat transfer medium may also be vaporized or gasified. The channel 203 between the air nozzles 201 comprises a push bar discharger, which comprises a bar 303, and at least two scrapers 302 shown in the figure, which are attached to the bar 303. The push bar discharger is arranged to be movable on the grate plane towards the ash chute 103 and in the opposite direction, which is illustrated by the arrow 404. When the push bar discharger and its scraper 302 move towards the ash chute, the scraper pushes ash 402 in front of it, which ash is thus conveyed towards the ash chute. Ash here refers to the burnt fuel as well as unburnt loose material, which may be conveyed to the boiler with fuel. This type of loose material may comprise, for example, metal pieces or stones.

The shape of the scraper is advantageously unsymmetrical in such a manner that when moving in the opposite direction, i.e. away from the ash chute on the grate plane, the scraper advantageously does not push ash in the opposite direction, or pushes less ash than when moving towards the ash chute. The scraper may, for example, move under the ash. This type of an unsymmetrical shape may be, for example, a triangle in cross-section, as shown in the figure. One side of such an unsymmetrical triangle is parallel to the plane of movement, i.e. the grate plane, which in the case of the figure is horizontal. In addition, the angle of the side of the unsymmetrical triangle on the side of the ash chute in relation to the plane of movement is larger than the angle of the side opposite the ash chute in relation to the plane of movement. In FIG. 4 the angle of the side on the ash chute side is a right angle in relation to the plane of movement. In addition to a triangle, other cross section shapes are also possible. For example, the side of the scraper on the ash chute side may be concave and the opposite side convex. An example of this type of a shape as seen from above (FIG. 3) is a V-shaped scraper, which has a shape that opens towards the ash chute. Advantageously the shape of the scraper is unsymmetrical in such a manner that when moving towards the ash chute it supplies material in front of it and when moving in the opposite direction it moves away from under the material due to its wedge-like shape. The push bar discharger, which comprises one scraper blade at its end, is generally also called a scraper or a scraper discharger. This type of a scraper discharger may also function as an ash removal means, even though it may be necessary to use a larger path of movement with the scraper discharger than with a push bar discharger.

Thus, the push bar discharger 301 is arranged to move on the plane of the grate 102 towards the ash chute 103 and in the opposite direction. The push bar discharger comprises at least one scraper 302 and a bar 303, to which at least one scraper is attached. When the push bar scraper moves, both its bar 303 and its scrapers move. Advantageously the scrapers are shaped unsymmetrical, in which case when moving towards the nearest ash chute they push ash 402 in front of them towards the ash chute 103, but they do not push as much ash in front of them when moving in the opposite direction. Thus, the push bar discharger is arranged to mechanically move ash on the grate and to remove ash from the boiler. Since this type of a reciprocating movement may wear the grate, a protective structure 401 may also be arranged in the grate between the scraper and the rest of the grate. The protective structure may be, for example, a wearing plate, and it may be changeable during maintenance of the boiler.

Figure 5:
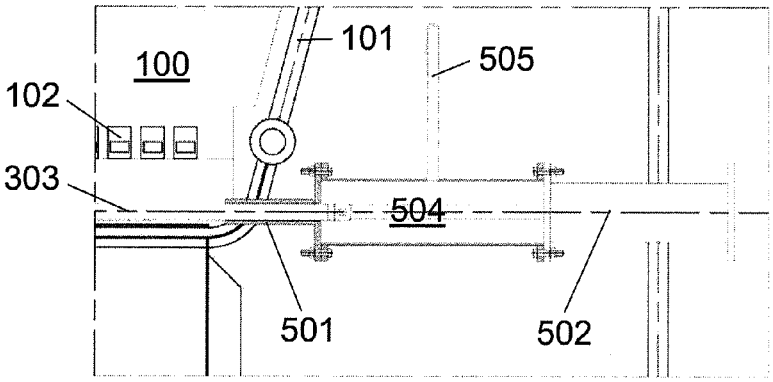
FIG. 5 shows an enlargement of part V of FIG. 1.

FIG. 5 shows a solution for moving the push bar discharger. In this solution the bar 303 or another part of the push bar discharger, or some part of an actuator is brought outside the furnace 100 through the boiler wall 101 or the grate 102, via, for example, a through hole 501. Alternatively some part of the push bar discharger, or some part of the actuator is brought outside the boiler by means of wall through hole 501. The through hole may be implemented, for example, by means of a through bushing. The bar is attached to the actuator 502, which is arranged to direct the reciprocating movement described above to the bar 303 of the push bar discharger, and via the bar to the entire push bar discharger 301. The actuator 502 may operate, for example, by compressed air, hydraulically or mechanically, and it may be, for example, a compressed air cylinder or a hydraulic cylinder. The actuator may be arranged in the furnace. More advantageously the actuator is arranged outside the furnace. The force directed at the bar 303 by the actuator may be arranged to be sufficient from the point of view of transferring ash. Both the width and depth of the channel 203, as well as the shape and number of the scraper or scrapers, as well as their location may affect the required force. More force is needed in a deep and wide channel than in a shallow and narrow channel, and correspondingly, a high scraper may require more force than a low scraper. A hydraulic actuator 502 may be able to produce larger force than a compressed air actuator.

The ash removal means can be attached to an actuator in, for example, a pressurized space outside the furnace. For example, in FIG. 5 the bar 303 is attached to the actuator 502 in a bar space 504, which functions as a pressurizing space. Some part of the ash removal means and/or some part of the actuator is situated in the bar space. If the pressure of the furnace 100 were higher than the pressure of the bar space 504, sand and/or ash might travel from the furnace via the through hole to the bar space, which might disturb the operation of the actuator 502. The pressure-difference between the furnace 100 and the bar space 504 can be evened by bringing compressed air to the bar space via, for example, pipe 505. Pressure in the bar space 504 can also be higher than the pressure in the furnace, in which case the compressed air is discharged from the through hole 501 to the furnace 100 as primary air for combustion.

The pressurized space in is in connection with the through hole 501. The bar 303 or some other part of the push bar discharger, or some part of the actuator, or both of them, are located in the bar space 504. In addition, the actuator 502 has its own through holes if necessary, for example, for the push bar of a cylinder. The cylinder may be attached to the bar space.

In the grate shown in FIGS. 1 to 5 the ash chute 103 is arranged in the first edge of the grate, and the actuator 502 in the opposite edge. It is, however, possible that the ash chute is arranged in the middle of the grate. Thus, it is possible to arrange push bar discharges as described above in large grates on both sides of the ash chute at two opposite edges of the grate. In small grates, where the ash chute is in the middle of the grate, it may be possible to use one, long push bar discharger in each channel 203 in such a manner that each push bar discharger continues over the ash chute. Thus, all actuators of the grate solution may be located on the same edge of the grate. In this kind of a solution the scrapers on different sides of the ash chute move in different directions in relation to the ash chute: on the first side of the chute towards the chute and on the second side away from the chute. Correspondingly, unsymmetrical scrapers may be arranged on different sides of the chute in different directions, i.e. to always push ash towards the ash chute. In addition, it is possible that the grate comprises an ash chute on both of its edges, and each scraper is arranged to move ash from the grate towards the ash chute closest to the scraper. For example, on the first side of the grate towards the ash chute of the first side, and on the second side towards the ash chute of the second side. It is obvious the ash chute or several ash chutes may also located elsewhere than on the central line or at the edges of the grate, and each scraper may be arranged to move ash towards the ash chute closest to the scraper in question. In addition, even if the grate would comprise only one ash chute, the actuator 502 could be arranged on the same side of the grate with the ash chute, in which case the bar of the push bar discharger would travel over the ash chute. A solution, where actuators are on both sides of the grate may be more expensive to implement than a solution where actuators are only on one side of the grate. In addition, it is possible that one actuator is arranged to move several ash removal means.

In the embodiment shown in the figures, at least one edge of the grate is at the edge of the ash chute 103. Thus, at least one scraper of the push bar discharger is arranged to push ash towards the edge of the grate. If the ash chute is located on the central line of the grate, the grate is a two-part one, and each part has a shared edge with the edge of the ash chute 103. Thus, also in cases where the ash chute is in the middle of the grate, at least one scraper of the push bar discharger is arranged to push ash towards the edge of parts of the grate, i.e. the edge of the grate. Also, in the case of several ash chutes, at least one scraper of the push bar discharger is arranged to push ash towards some edge of the grate.

Figure 6:
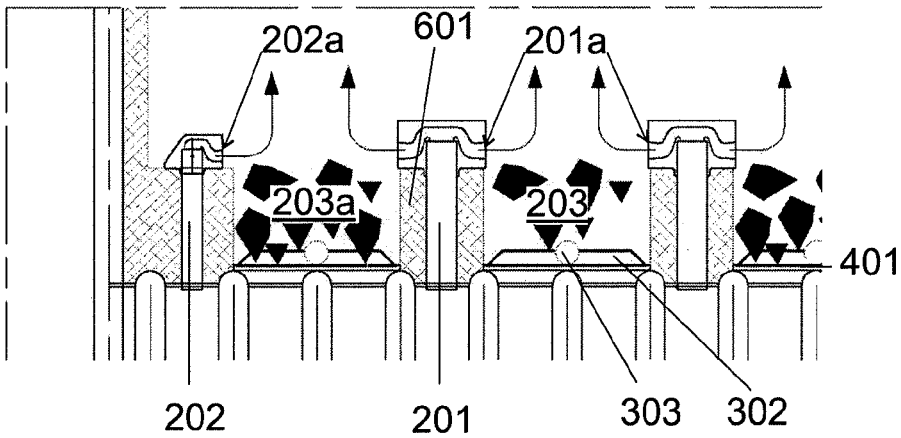
FIG. 6 shows an enlargement of part VI of FIG. 2, and FIGS. 7*a* to 7*d* show some embodiments of an ash removal means in a side and end view (FIGS. 7*a* and 7*c*, as well as 7*b* and 7*d*, correspondingly).

FIG. 6 shows in more detail some channels 203 of the grate 102 and scrapers 302 in the channels. FIG. 6 is an enlargement of part VI of FIG. 2. Channels remain between the air nozzles 201, 202. The width of the air nozzles at the air outlets 201*a*, 202*a* is typically larger than in the lower part of the air nozzles. The channel remaining between this type of air nozzles would naturally widen towards its bottom. A channel with a shape widening towards the bottom of the grate could become clogged during use due to unburnt impurities brought along with the fuel, such as metal objects. To solve this problem, the width of the channel in FIG. 6 is arranged substantially constant for its entire height by means of the refractory 601 of the air nozzles. By means of the refractory it is also possible to make the channels mutually of the same width, as shown in the figure. Especially the outermost channel 203*a* of the grate is narrowed by means of the refractory to be as wide as the other channels 203. This may be advantageous from the point of view of manufacture, because then it is possible to use similar ash removal means in all channels. By means of the refractory, it may be possible to make the channel 203 narrower towards its bottom, in which case also the clogging problem described above is removed. In the direction perpendicular to FIG. 6 the channels 203 are advantageously straight and their shape is the same throughout the channel, for example, throughout the entire grate. FIG. 6 shows the cross section of a bar 303 of a push bar discharger. The bar 303 is advantageously arranged in the cross direction in the middle of the channel 203 and the bar may be round in cross section. Other cross section shapes are also possible, but it is advantageous to fit the shape of the through hole 501 or the through bushing (FIG. 5) to the shape of the cross section of the bar.

Figure 7A:
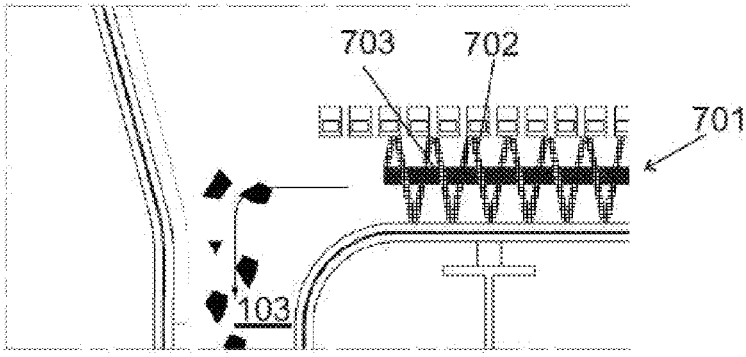
Figure 7B:
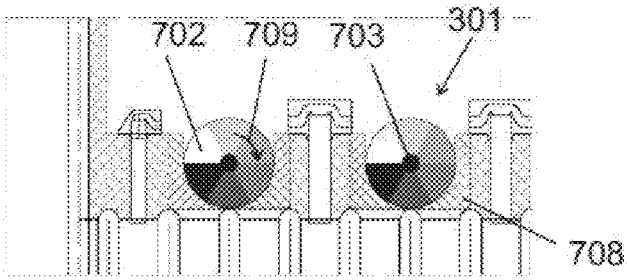

Some other embodiments of the ash removal means for moving and removing ash mechanically from a boiler are illustrated in FIGS. 7*a* to 7*d*. FIG. 7*a* shows a side view of an ash removal means, a screw discharger 701. The screw discharger may comprise an axis 703 and a thread part 702 attached to it. Some screw dischargers comprise only the thread part 702. A supporting structure may also be arranged for the screw discharger to support the screw discharger in a direction perpendicular to the longitudinal direction. The channel 203 may function as such a supporting structure. When the thread part 702 of the screw discharger rotates around its axis, the thread part pushes the ash in the screw discharger towards the ash chute 103. It may be that the angle of elevation of the screw discharger is not even over the entire operational range. It may be, for example, that the angle of elevation of the screw discharger is steeper near the ash chute than when far from it. Thus, the screw discharger may discharge ash more evenly than a screw discharger with an even angle of elevation. FIG. 7*b* shows two screw dischargers in an end view as seen from the ash chute. The direction of rotation of the thread parts of the screw dischargers is illustrated by the arrow 709. If the screw discharger also comprises an axis, the thread parts may be arranged to rotate along with the axis. A grate protecting structure, such as a wearing plate, may be arranged between the thread parts and the grate, for example between the thread parts 702 and the refractory 708. The axis of the screw discharger may be arranged to be attached to an actuator, which actuator may rotate the axis or the thread parts of the screw discharger. The actuator may be located in the furnace, or more advantageously outside the furnace. If the actuator is arranged outside the furnace, the boiler comprises a through hole for bringing a part of the ash removal means, such as an axis, in connection with the actuator. The through hole may especially comprise and axis seal, with which the through hole of the axis of the screw discharger is arranged to be sealed for the existing pressure differences.

Figure 7C:
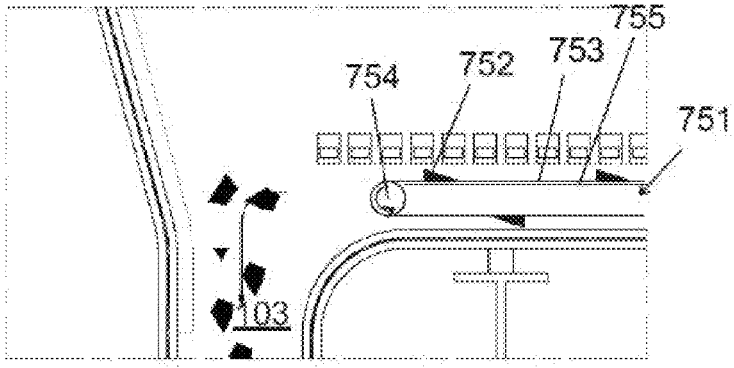
Figure 7D:
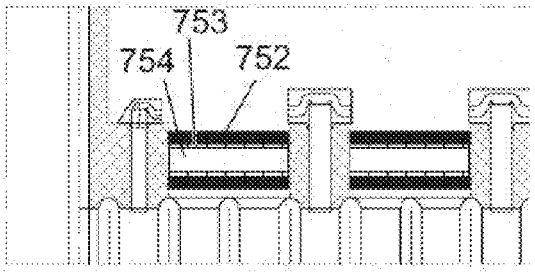

A third option for an ash removal means is a belt discharger. A side view of a belt discharger 751 is shown in FIG. 7*c*. The belt discharger 751 comprises a belt 753, which is arranged to move by means of a belt pulley 754. The rotation direction of the belt pulley 754 is shown by the arrow marked on the pulley. The belt discharger may also comprise a scraper 752, by which the ash moving ability of the belt may be improved. In addition, the belt discharger may comprise a support plane 755. The belt of the belt discharger may be manufactured of, for example, metal, such as steel. A problem with the belt discharger may be the lateral movement of the belt. This problem can be prevented by supports arranged in the belt pulley 754. In addition, the channel 203 may function as a lateral support structure for the belt discharger. On the bottom of the channel, between the belt discharger and the grate may be arranged a structure supporting the grate, such as a wearing plate. FIG. 7*d* shows two belt dischargers in an end view as seen from the ash chute. Also at the other end (not shown) of the belt discharger, there may be another belt pulley. An actuator may be arranged to rotate the other belt pulley, in which case the belt of the belt discharger moves and transfers ash towards the ash chute 103. The actuator may be arranged outside the furnace. If the actuator is arranged outside the furnace, the boiler comprises a through hole for bringing a part of the ash removal means in connection with the actuator.

In the embodiments according to FIGS. 7*a* to 7*d*, the actuator may be a motor, which rotates the screw discharger or the belt pulley. This type of a motor may operate, for example, electronically, hydraulically or by compressed air. A part of the ash removal means may have been brought outside the furnace via a through hole. In accordance with FIG. 5, a part of the ash removal means can be brought via a through hole to a pressurized space. Thus, a part of the ash removal means is arranged outside the furnace in a pressurized space. Pressure in the pressurized space may be at least equal to the pressure in the furnace. Thus, the pressure in the pressurized space prevents the material in the boiler from moving outside the furnace. In addition, the ash removal means may be attached to an actuator.

In the embodiments according to FIGS. 6 and 7, the air outlets 201*a*, 202*a* of the air nozzles 201, 202 are located in the upper part of the channel 203. Thus, combustion substantially takes place above the air nozzles and not in the actual channel 203. In such a solution the temperature in the channel is significantly lower than elsewhere in the furnace. Thus, the ash removal means arranged movable in the channel, such as a push bar discharger 301, a screw discharger 701 or a belt discharger 751 are not subjected to especially hot and demanding conditions. This type of a solution may improve the reliability of the ash removal means and increase the expected operating life. In addition, with this kind of a solution it is ensured that heavy solids are separated from fine solids by means of screening based on air flow, in which case especially large particles, such as ash, are gathered in the channels 203, while smaller particles are fluidized by means of fluidizing air. To ensure screening in this type of a grate structure, primary air is not supplied to the furnace from the bottom of the channels 203, i.e. primary air is not supplied through the ash removal means, but primary air is supplied to the boiler from points between the channels 203 in the grate, for example by air nozzles 201, 202.

According to the examples described above, the ash removal means is a mechanized means, which by its own movement transfers the ash and other material brought to the channel. The ash removal means operates as a conveyor, which is located inside the boiler, and is situated above the wall that operates as a grate and is formed of cooling pipes. Ash is moved along the grate by means of a channel, for example along the above-mentioned wall. The ash removal means described above is suitable for channels with such a small inclination that ash and material do not flow off the grate by themselves and due to gravity. The transfer typically takes place substantially horizontally or towards the sides, depending on, for example, the inclination of the grate. Most advantageous is that the depth of the channel remains almost constant through its entire length. In the above examples the ash removal means inter alia pushes ash or carries it along, and discharges it to the desired space.

The invention is described in connection with a fluidized bed boiler and its grate, but ash removal means according to the above description may be used in other boilers as well.

The invention is not limited solely to the above-presented examples, but it can be applied within the scope of the appended claims.

The invention claimed is:

1. A boiler, comprising:

a furnace comprising walls and a grate, the grate comprising a set of air nozzles comprising air outlets and arranged to supply primary air into the furnace, and at least one channel arranged between the air nozzles and open on top, wherein the at least one channel is configured to collect ash and material from the furnace, and wherein the air outlets are arranged in an upper part of the at least one channel;

an ash chute, which is arranged to remove ash and material from the furnace;

at least one mechanized ash removal unit arranged in said at least one channel and configured to move ash and material along the at least one channel towards the ash chute, wherein the ash removal unit comprises a push bar discharger, a screw discharger, or a belt discharger; and a protective structure arranged between the at least one mechanized ash removal unit and the grate, wherein an angle of the grate in relation to a horizontal plane is less than 10 degrees.

2. The boiler according to claim 1, wherein the mechanized ash removal unit is arranged below the air nozzles.

3. The boiler according to claim 1, wherein the at least one channel is inclined with respect to a horizontal plane such that ash and material do not flow off the grate due to gravity.

4. The boiler according to claim 1, wherein the at least one channel is horizontal, and wherein the mechanized ash removal unit is configured to move ash and material along the at least one channel horizontally.

5. The boiler according to claim 1, wherein:

the grate comprises several said channels, wherein the channels are parallel; and the ash chute reaches several channels in such a manner that it is located next to the grate or between two parts of a grate divided into parts.

6. The boiler according to claim 1, wherein the grate comprises cooling pipes that are configured to transfer heat of the grate.

7. The boiler according to claim 1, wherein the boiler further comprises an air box, which is arranged below the grate and from where primary air may be supplied to the furnace through the grate.

8. The boiler according to claim 1, wherein said boiler is a bubbling fluidized bed boiler or a circulating fluidized bed boiler, where said primary air is arranged to simultaneously function as the fluidizing air in the furnace.

9. The boiler according to claim 1, wherein the protective structure comprises a wearing plate.

10. The boiler according to claim 9, wherein the wearing plate is changeable.

11. The boiler according to claim 1, wherein the ash removal unit comprises a bar discharger, the bar discharger comprising:

a bar, which is arranged to move back and forth controlled by an actuator; and several scrapers attached to the bar, which scrapers are shaped so that they are arranged to push ash and material along the at least one channel towards the ash chute.

12. The boiler according to claim 11, wherein:

the actuator is arranged outside the furnace; and the boiler comprises a through hole, through which some part of the ash removal unit or some part of the actuator can be brought through the wall of the boiler or the grate.

13. The boiler according to claim 12, further comprising:

a pressurized space arranged outside the furnace and to which said through hole is connected, whereby some part of the ash removal unit and/or some part of the actuator is located in said pressurized space.

14. A boiler, comprising:

a furnace comprising walls and a grate, the grate comprising a set of air nozzles comprising air outlets and arranged to supply primary air into the furnace, and at least one channel arranged between the air nozzles and open on top, wherein the at least one channel is configured to collect ash and material from the furnace, and wherein the air outlets are arranged in an upper part of the at least one channel;

an ash chute, which is arranged to remove ash and material from the furnace;

at least one mechanized ash removal unit arranged in said at least one channel and configured to move ash and material along the at least one channel towards the ash chute, wherein the ash removal unit comprises a bar discharger, the bar discharger comprising a bar, which is arranged to move back and forth controlled by an actuator, and several scrapers attached to the bar, which scrapers are shaped so that they are arranged to push ash and material along the at least one channel towards the ash chute; and a protective structure arranged between the at least one mechanized ash removal unit and the grate, wherein an angle of the grate in relation to a horizontal plane is less than 10 degrees.

15. The boiler according to claim 14, wherein:

the actuator is arranged outside the furnace; and the boiler comprises a through hole, through which some part of the ash removal unit or some part of the actuator can be brought through the wall of the boiler or the grate.

16. The boiler according to claim 15, further comprising:

a pressurized space arranged outside the furnace and to which said through hole is connected, whereby some part of the ash removal unit and/or some part of the actuator is located in said pressurized space.

* * * * *